US011595764B2

(12) United States Patent
McCutcheon

(10) Patent No.: US 11,595,764 B2
(45) Date of Patent: Feb. 28, 2023

(54) TUNING METHOD, MANUFACTURING METHOD, COMPUTER-READABLE STORAGE MEDIUM AND TUNING SYSTEM

(71) Applicant: ams Sensors UK Limited, Cambridge (GB)

(72) Inventor: Peter McCutcheon, Eindhoven (NL)

(73) Assignee: AMS SENSORS UK LIMITED, Cambridge (GB)

( * ) Notice: Subject to any disclaimer, the term of this patent is extended or adjusted under 35 U.S.C. 154(b) by 71 days.

(21) Appl. No.: 17/287,385

(22) PCT Filed: Sep. 18, 2019

(86) PCT No.: PCT/EP2019/075018

§ 371 (c)(1),
(2) Date: Apr. 21, 2021

(87) PCT Pub. No.: WO2020/083575

PCT Pub. Date: Apr. 30, 2020

(65) Prior Publication Data

US 2021/0400398 A1 Dec. 23, 2021

(30) Foreign Application Priority Data

Oct. 23, 2018 (EP) ..... 18202052

(51) Int. Cl.
*G10K 11/178* (2006.01)
*H04R 25/00* (2006.01)
*H04R 1/10* (2006.01)

(52) U.S. Cl.
CPC ..... *H04R 25/40* (2013.01); *G10K 11/17813* (2018.01); *G10K 11/17881* (2018.01); *H04R 1/1016* (2013.01); *H04R 2460/01* (2013.01)

(58) Field of Classification Search
CPC ..... G10K 11/1781; G10K 11/17813; G10K 11/17815; G10K 11/17817;
(Continued)

(56) References Cited

U.S. PATENT DOCUMENTS 4,494,074 A 1/1985 Bose
4,852,177 A 7/1989 Ambrose
(Continued)

FOREIGN PATENT DOCUMENTS

GB 2445984 A 7/2008

OTHER PUBLICATIONS

Elliot, S, "Signal Processing for Active Control", Academic Press, 2001, Chapters 6.1.2, 22 pages.
(Continued)

*Primary Examiner* — Kile O Blair
(74) *Attorney, Agent, or Firm* — MH2 Technology Law Group LLP

(57) ABSTRACT

A method for tuning filter parameters of a noise cancellation enabled audio system with an ear-mountable playback device comprising a speaker and a feedback noise microphone located in proximity to the speaker comprises provision of acoustic transfer functions between the speaker and the feedback noise microphone, between the speaker and an eardrum, between an ambient sound source and the eardrum and between the ambient sound source and the feedback noise microphone. The parameters of a feedback filter function, which is designed to process a feedback noise signal, are tuned. A noise cancellation performance of the audio system at the eardrum is determined based on each of the acoustic transfer functions and on the feedback filter function.

16 Claims, 3 Drawing Sheets

(58) Field of Classification Search
CPC ... G10K 11/17819; G10K 2210/30232; G10K 2210/3033; G10K 2210/3048; G10K 2210/3055; G10K 2210/3057
See application file for complete search history.

(56) References Cited

U.S. PATENT DOCUMENTS

| | | | | |
|---|---|---|---|---|
| 5,138,664 | A | 8/1992 | Kimura et al. | |
| 9,179,237 | B2 | 11/2015 | Pan et al. | |
| 2010/0105447 | A1* | 4/2010 | Sibbald | G10K 11/17857 381/71.6 |
| 2014/0044275 | A1* | 2/2014 | Goldstein | H04R 1/1083 381/71.6 |
| 2015/0086031 | A1* | 3/2015 | Goto | G10K 11/17817 381/71.8 |

OTHER PUBLICATIONS

International Search Report and Written Opinion in corresponding International Application No. PCT/EP2019/075018 dated Dec. 20, 2019, 12 pages.

* cited by examiner

TUNING METHOD, MANUFACTURING METHOD, COMPUTER-READABLE STORAGE MEDIUM AND TUNING SYSTEM

CROSS-REFERENCE TO RELATED APPLICATIONS

The present application is the national stage entry of International Patent Application No. PCT/EP2019/075018, filed on Sep. 18, 2019, and published as WO 2020/083575 A1 on Apr. 30, 2020, which claims the benefit of priority of European Patent Application No. 18202052.9, filed on Oct. 23, 2018, all of which are incorporated by reference herein in their entirety.

FIELD

The present disclosure generally relates to noise cancellation enabled audio systems, and particularly to a method for tuning filter parameters of such systems, a method for manufacturing such systems, a computer-readable storage medium and a tuning system for tuning filter parameters of such systems.

BACKGROUND OF THE INVENTION

Nowadays a significant number of headphones are equipped with noise cancellation techniques. For example, such noise cancellation techniques are referred to as active noise cancellation or ambient noise cancellation, both abbreviated with ANC. ANC generally makes use of recording ambient noise that is processed for generating a compensation signal or anti-noise signal, which is then combined with a useful audio signal to be played over a speaker of the headphone.

Various ANC approaches make use of feedback, FB, microphones, feedforward, FF, microphones or a combination of feedback and feedforward microphones.

Traditionally, feedback cancellation is tuned to produce optimum noise cancellation at the FB microphone which conventionally is placed in close proximity to the speaker. The further away from the speaker the FB microphone is, the longer the propagation delay from the speaker to the FB microphone. This usually reduces the upper band in which FB ANC can operate, therefore its position is selected close to the speaker driver and not close to the ear. This approach is chosen because a feedback system relies upon monitoring the cancelled signal in order to work, so it follows that it is optimized at this point. However, humans hear the signal at a slightly different point, namely the eardrum. This point is often referred to as the drum reference point, DRP. The result of this conventional approach can be reduced cancellation at the DRP, compared to the FB microphone, or it can result in increased overshoot, e.g. noise boost, at the DRP in the frequency region just above the ANC band.

Nevertheless, it is often considered acceptable to ignore any differences in noise cancellation between the FB microphone and the DRP. Hence when tuning filters for FB noise cancellation, the FB microphone is typically used as the location for the prediction of ANC. The ANC is then subjectively evaluated at the ear by listening or measuring on a head and torso simulator, HATS. This results in a "black box" tuning where the manufacturer must tune, listen and tune again to get the optimum ANC with minimal overshoot. Headphone manufacturers usually ensure that there is a minimal acoustic impedance difference between the FB microphone and the eardrum to ensure that the ANC at the FB microphone and the ear is as similar as possible.

SUMMARY OF THE INVENTION

The present disclosure provides an improved tuning concept for tuning filter parameters of noise cancellation enabled audio systems.

The improved tuning concept is based on the idea that the overall ANC performance of a noise cancellation enabled audio system employing feedback ANC can be improved by tuning filter parameters based on ANC performance at the eardrum or DRP instead of solely relying on ANC performance at the feedback microphone.

The shortcoming in conventional FB ANC tuning methods is that designing a filter for optimum ANC at the FB microphone often results in noise boosting at the DRP above the cancellation band, which is typically where human hearing is most sensitive. The improved tuning concept allows the FB ANC performance to be calculated and observed at the DRP during the tuning stage, and therefore the FB filter can be tuned to optimize the noise cancellation at this point which is what we hear. In other words, with the improved tuning concept it can be calculated and visualized or otherwise evaluated what could only be heard in conventional implementations previously.

This leads to reduced mismatches between what the filter design calculates and what can be hears, so there is a faster design process. It also gives the user the opportunity to design better filters, e.g. rather than reducing the high frequency gain of the FB filter, compromising the FB cancellation at lower frequencies, the user can optimally tune the FB filter to manage the overshoot and the amount of lower frequency noise cancellation.

To this end the improved tuning concept proposes to calculate ANC performance of the audio system at the eardrum based on various acoustic parameters that can be determined or measured beforehand, for example, and based on filter parameters of a feedback filter employed in the feedback ANC. For example, the acoustic parameters are various acoustic transfer functions between selected positions in and around the audio system as described in the following.

For example, a noise cancellation enabled audio system encompasses an ear-mountable playback device like a headphone, earphone or mobile device that comprises a speaker and a feedback noise microphone located in proximity to the speaker. In such a system a first acoustic transfer function may be defined between the speaker and the feedback noise microphone. A second acoustic transfer function may be defined between the speaker and an eardrum being exposed to the speaker. A third acoustic transfer function may be defined between an ambient sound source and the eardrum. A fourth acoustic transfer function may be defined between the ambient sound source and the feedback noise microphone. For example, the acoustic transfer functions are measured with the playback device being placed on a measurement fixture, for example a head and torso simulator, HATS.

Knowledge of these acoustic transfer functions allows to calculate the ANC performance at the eardrum or DRP based on tuned filter parameters of the feedback filter, in particular without the need for physical access to the playback device during tuning. Hence, the filter parameters of the feedback filter can be tuned with less effort until a desired performance at the eardrum or DRP is achieved.

The playback device may further comprise an ambient noise microphone for obtaining a feedforward noise signal, such that the audio system is configured for performing both feedback noise cancellation based on the feedback noise signal and feedforward noise cancellation based on the feedforward noise signal. When such a hybrid system, i.e. a system with both FF and FB ANC is considered, the FB ANC can change an FF target function.

Hence, having access to the ANC performance at the eardrum or the DRP has further positive effects. For example, filter parameters of a feedforward filter cannot be reliably tuned until the feedback ANC has been fixed. For example, in conventional approaches, the feedback ANC has to be approved and measured, and acoustic transfer functions required for the feedforward target have to be measured with the feedback ANC being active. The net result in conventional systems is that not only is it a trial and error approach used for tuning the optimal feedback filter, but also that the feedforward filter is dependent upon an acoustic response that is only decided once the feedback ANC has been tuned. This means that a conventional feedforward filter tuning process cannot start until the feedback tuning process and listening tests have been completed. After the tuning process, if anything changes further down the line, like an acceptable distortion, mutations with the electronics, acoustic modifications, etc., then the entire conventional tuning process starts again from the beginning.

Hence, according to an aspect of the improved tuning concept, a fifth acoustic transfer function between the ambient sound source and the ambient noise microphone is used during the tuning process. This allows determination of adjusted acoustic transfer functions between the speaker and the eardrum and between the ambient sound source and the eardrum that form the basis of a determination of a feedforward filter target function. Accordingly, filter parameters of the feedforward filter can be tuned to match the feedforward target function taking into account the feedback ANC.

This disclosure offers a solution to both these problems by defining a method to calculate the FB ANC at the ear and, optionally, to calculate the difference in FF Target when FB ANC is active; both of which can be applied at the filter tuning stage, e.g. in software, so subjective evaluation is not required. This means that instantly, the user tuning the FB and, optionally, FF ANC filters can see the correct FB or hybrid ANC performance and tune the filters to get a truly optimized ANC performance. This ultimately results in the ability to tune better parameters for both FB and hybrid ANC headphones, and a faster, simpler development cycle.

The improved tuning concept is for example applied at a design stage, potentially on units that are not fully assembled, or in different states of assembly. Particularly, the improved tuning concept is used before shipment and use of the noise cancellation enabled audio system with the ear-mountable playback device.

For example, a method for tuning filter parameters of a noise cancellation enabled audio system with an ear-mountable playback device according to the improved tuning concept is described in the following. The playback device, which may be a headphone, earphone, mobile phone or other mobile device, comprises a speaker and a feedback noise microphone located in proximity to the speaker.

According to the method, a first acoustic transfer function between the speaker and the feedback noise microphone, a second acoustic transfer function between the speaker and an eardrum being exposed to the speaker, a third acoustic transfer function between an ambient sound source and the eardrum, and a fourth acoustic transfer function between the ambient sound source and the feedback noise microphone are provided. Parameters of a feedback filter function being designed to process a feedback noise signal obtained with the feedback noise microphone are tuned. A noise cancellation performance of the audio system at the eardrum is determined based on each of the first, second, third and fourth acoustic transfer functions and on the feedback filter function.

This allows a user employing the tuning method to recognize the effects of the tuning of the parameters of the feedback filter with respect to an actual ANC performance at the eardrum or DRP. For example, if the user is not satisfied with the result of the tuning, tuning of the parameters can be continued or repeated until a desired level of feedback ANC performance at the eardrum is achieved.

For example, the method is carried out in a design stage of the noise cancellation enabled audio system and/or the ear-mountable playback device, e.g. before shipment and/or use of the noise cancellation enabled audio system with the ear-mountable playback device.

For example, the method further comprises visualizing the noise cancellation performance. Furthermore, the steps of tuning parameters, determining of the noise cancellation performance and visualizing are performed repeatedly. Hence, the tuning process is made more convenient for a user of the method, e.g. as small changes in the parameters can be visualized with their effect immediately or almost immediately. Furthermore, no measurements are required between different tuning steps where filter parameters change.

In various implementations of the method, determining the noise cancellation performance comprises determining a noise function at the eardrum based on each of the first, second, third and fourth acoustic transfer functions and on the feedback filter function, and determining the noise cancellation performance based on the noise function and the third acoustic transfer function.

For example, the noise function corresponds to an error signal at the ear, which for example is a residual between an ambient sound and the ANC signal provided by the speaker. Hence, this signal can form the basis of a measure of the ANC performance at the ear.

For example, the noise function E is determined according to $$E = \frac{AE + B(AE.DFBM - AFBM.DE)}{1 + B.DFBM} \tag{1}$$

and the noise cancellation performance ANC is determined according to $$ANC = \frac{E}{AE}, \tag{2}$$

with DFBM being the first acoustic transfer function, DE being the second acoustic transfer function, AE being the third acoustic transfer function, AFBM being the fourth acoustic transfer function and B being the feedback filter function.

Compared to an error signal at the feedback microphone, which may be used in conventional systems, the error signal or noise signal at the eardrum provides a more accurate representation of the ANC performance.

Accordingly, for example, the noise cancellation performance at the eardrum is different, e.g. determined differently, to a further noise cancellation performance at the feedback noise microphone.

In various implementations of the tuning method, the playback device further comprises an ambient noise microphone, e.g. a feedforward microphone, for obtaining a feedforward noise signal. In such a configuration the audio system is configured to perform both feedback noise cancellation based on the feedback noise signal and feedforward noise cancellation based on the feedforward noise signal.

In such a configuration the tuning method further comprises providing a fifth acoustic transfer function between the ambient sound source and the ambient noise microphone. The fifth acoustic transfer function may be determined or measured before the actual tuning process, similar to the four acoustic transfer functions described above. A first adjusted acoustic transfer function is determined between the speaker and the eardrum based on the first acoustic transfer function, the second acoustic transfer function and on the feedback filter function. Furthermore, a second adjusted acoustic transfer function is determined between the ambient sound source and the eardrum based on each of the first, second, third and fourth acoustic transfer functions and on the feedback filter function. Based on the first and second adjusted acoustic transfer functions and on the fifth acoustic transfer function, a feedforward filter target function is determined. Parameters of a feedforward filter function being designed to process the feedforward noise signal are tuned, e.g. based on the feedforward filter target function.

Determination of the first and the second adjusted acoustic transfer function takes into account that an active feedback ANC has influence on the acoustic behavior of the playback device. For example, sound from an ambient sound source has to be processed differently by the feedforward filter function depending on whether feedback ANC is active or not. Hence, the feedforward filter target function is adapted to actual parameters of the active feedback ANC without the need for any additional measurements during the tuning process.

In some implementations, the feedforward filter target function is visualized. This allows, for example, easier tuning of the feedforward filter parameters to match or approximate the target function. For example, also the feedforward filter function is visualized during tuning of its parameters.

For example, the first adjusted acoustic transfer function DE' is determined according to $$DE' = \frac{DE}{1 + B.DFBM} \tag{3}$$

and the second adjusted acoustic transfer function AE' is determined according to $$AE' = \frac{AE + B(AE.DFBM - AFBM.DE)}{1 + B.DFBM}, \tag{4}$$

with DFBM being the first acoustic transfer function, DE being the second acoustic transfer function, AE being the third acoustic transfer function, AFBM being the fourth acoustic transfer function and B being the feedback filter function.

In various implementations, the tuning method further comprises measuring the first, second, third and fourth, and, optionally, the fifth acoustic transfer function with the playback device placed on a measurement fixture, e.g. a head and torso simulator, HATS, or the like. This allows to have a reliable base for the tuning process.

The tuning method according to one of the various implementations described above can be used for manufacturing noise cancellation enabled audio systems. For example, each playback device of such an audio system could be tuned separately, including the determination and provision of the respective acoustic transfer functions needed. Hence, each playback device would have its own filter parameters being tailored to the individual device.

However, assuming, for example, negligible tolerances during production of the playback devices, and therefore assuming same or similar acoustic transfer functions for the audio playback devices, it may be sufficient to e.g. perform measurements with one representative audio playback device for determining the respective acoustic transfer functions, tuning the filter parameters for this audio playback device and applying the filter parameters to this audio playback device and several others of the same kind. For example, the tuned filter parameters are applied to several or all devices of a lot produced with the same process or the like. Hence, the tuning effort can be reduced.

For example, a method for manufacturing noise cancellation enabled audio systems according to the improved tuning concept comprises manufacturing one or more audio systems together with a respective associated ear-mountable playback device comprising a speaker and a feedback noise microphone located in proximity to the speaker. Filter parameters of a feedback filter function are tuned with a tuning method according to one of the implementations described above, wherein the first, second, third and fourth acoustic transfer functions are determined, e.g. determined beforehand, employing at least one of the one or more audio systems or playback devices. The tuned filter parameters are applied to the one or more audio systems.

If the playback device also has an ambient noise microphone, determination and usage of the fifth filter function as described above can be included in the manufacturing method.

According to another aspect of the improved tuning concept, a non-transitory computer readable storage medium storing instructions thereon is disclosed. In particular, the instructions when executed by a processor cause the processor to implement the tuning method according to one of the implementations described above. For example, the respective acoustic transfer functions are received by the processor when executing the instructions. The instructions can be used both for feedback-only ANC enabled audio systems and hybrid ANC systems.

Further aspects of the improved tuning concept refer to a tuning system for tuning filter parameters of a noise cancellation enabled audio system with an ear-mountable playback device. For example, such a tuning system is configured to carry out the tuning method according to one of the embodiments described above. For example, the tuning system is configured to perform tuning for audio systems with only feedback ANC or with hybrid ANC. The system is particularly configured to receive the respective acoustic transfer functions as described above as a basis for the tuning process. The tuning system may be configured to provide an interface for tuning of the filter parameters, respectively.

The tuning system may be implemented as a computing device like a workstation computer, notebook or tablet computer or the like.

BRIEF DESCRIPTION OF THE DRAWINGS

The improved tuning concept will be described in more detail in the following with the aid of drawings. Elements having the same or similar function bear the same reference numerals throughout the drawings. Hence their description is not necessarily repeated in following drawings.

In the drawings.

DETAILED DESCRIPTION

Figure 1:
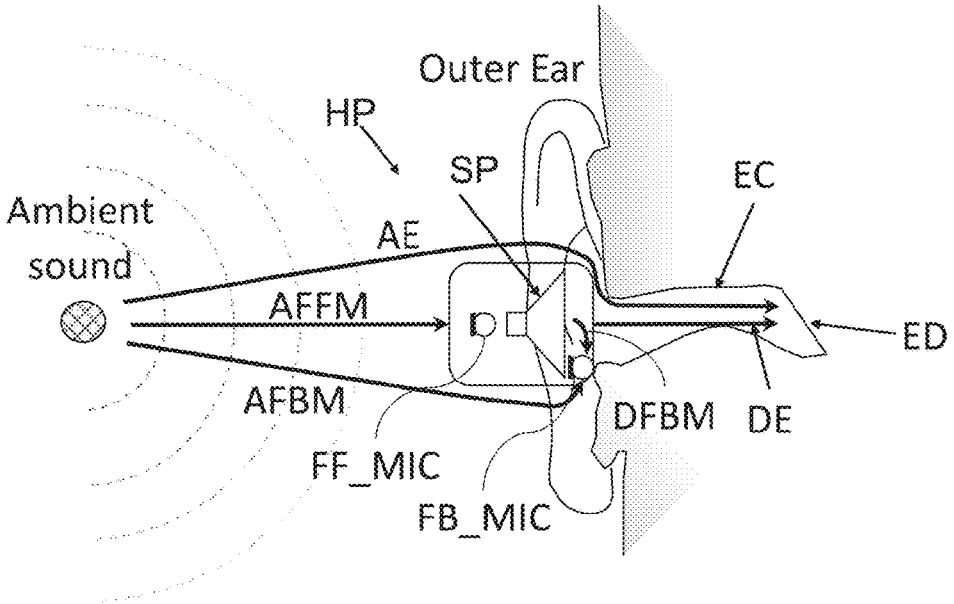
FIG. 1 shows an example headphone worn by a user with several sound paths.

FIG. 1 shows an example configuration of a headphone HP worn by a user with several sound paths. The headphone HP shown in FIG. 1 stands as an example for any ear mountable playback device of a noise cancellation enabled audio system and can e.g. include in-ear headphones or earphones, on-ear headphones or over-ear headphones. Instead of a headphone, the ear mountable playback device could also be a mobile phone or a similar device.

The headphone HP in this example features a loudspeaker SP, a feedback noise microphone FB_MIC and, optionally, an ambient noise microphone FF_MIC, which e.g. is designed as a feedforward noise cancellation microphone. Internal processing details of the headphone HP are not shown here for reasons of a better overview.

In the configuration shown in FIG. 1, several sound paths exist, of which each can be represented by a respective acoustic response function or acoustic transfer function. For example, a first acoustic transfer function DFBM represents a sound path between the speaker SP and the feedback noise microphone FB_MIC, and may be called a driver-to-feedback response function. The first acoustic transfer function DFBM may include the response of the speaker SP itself. A second acoustic transfer function DE represents the acoustic sound path between the headphone's speaker SP, potentially including the response of the speaker SP itself, and a user's eardrum ED being exposed to the speaker SP, and may be called a driver-to-ear response function. A third acoustic transfer function AE represents the acoustic sound path between the ambient sound source and the eardrum ED through the user's ear canal EC, and may be called an ambient-to-ear response function. A fourth acoustic transfer function AFBM represents the acoustic sound path between the ambient sound source and the feedback noise microphone FB_MIC, and may be called an ambient-to-feedback response function.

If the ambient noise microphone FF_MIC is present, a fifth acoustic transfer function AFFM represents the acoustic sound path between the ambient sound source and the ambient noise microphone FF_MIC, and may be called an ambient-to-feedforward response function.

Response functions or transfer functions of the headphone HP, in particular between the microphones FB_MIC and FF_MIC and the speaker SP, can be used with a feedback filter function B and feedforward filter function F, which may be parameterized as noise cancellation filters during operation.

The headphone HP as an example of the ear-mountable playback device may be embodied with both the microphones FB_MIC and FF_MIC being active or enabled such that hybrid ANC can be performed, or as a FB ANC device, where only the feedback noise microphone FB_MIC is active and an ambient noise microphone FF_MIC is not present or at least not active. Hence, in the following, if signals or acoustic transfer functions are used that refer to the ambient noise microphone FF_MIC, this microphone is to be assumed as present, while it is otherwise assumed to be optional.

Any processing of the microphone signals or any signal transmission are left out in FIG. 1 for reasons of a better overview. However, processing of the microphone signals in order to perform ANC may be implemented in a processor located within the headphone or other ear-mountable playback device or externally from the headphone in a dedicated processing unit. If the processing unit is integrated into the playback device, the playback device itself forms a noise cancellation enabled audio system. If processing is performed externally, the external device or processor together with the playback device forms the noise cancellation enabled audio system. For example, processing may be performed in a mobile device like a mobile phone or a mobile audio player, to which the headphone is connected with or without wires.

If the first four acoustic transfer functions DFBM, DE, AE and AFBM of a FB ANC-enabled playback device are known, ANC performance at the eardrum ED can be calculated for a given feedback filter function B. Hence, effects of tuning of the feedback filter function B can be directly visualized without the need for further measurements. This will be explained in more detail below.

Furthermore, if the playback device is enabled for hybrid ANC, further knowledge of the fifth acoustic transfer function AFFM allows to calculate a target function for the feedforward filter function F, thereby including the effects of the feedback ANC. Also this will be explained in more detail below. Accordingly, for tuning the ANC filter functions B and optionally F, the respective acoustic transfer functions have to be provided.

Figure 2:
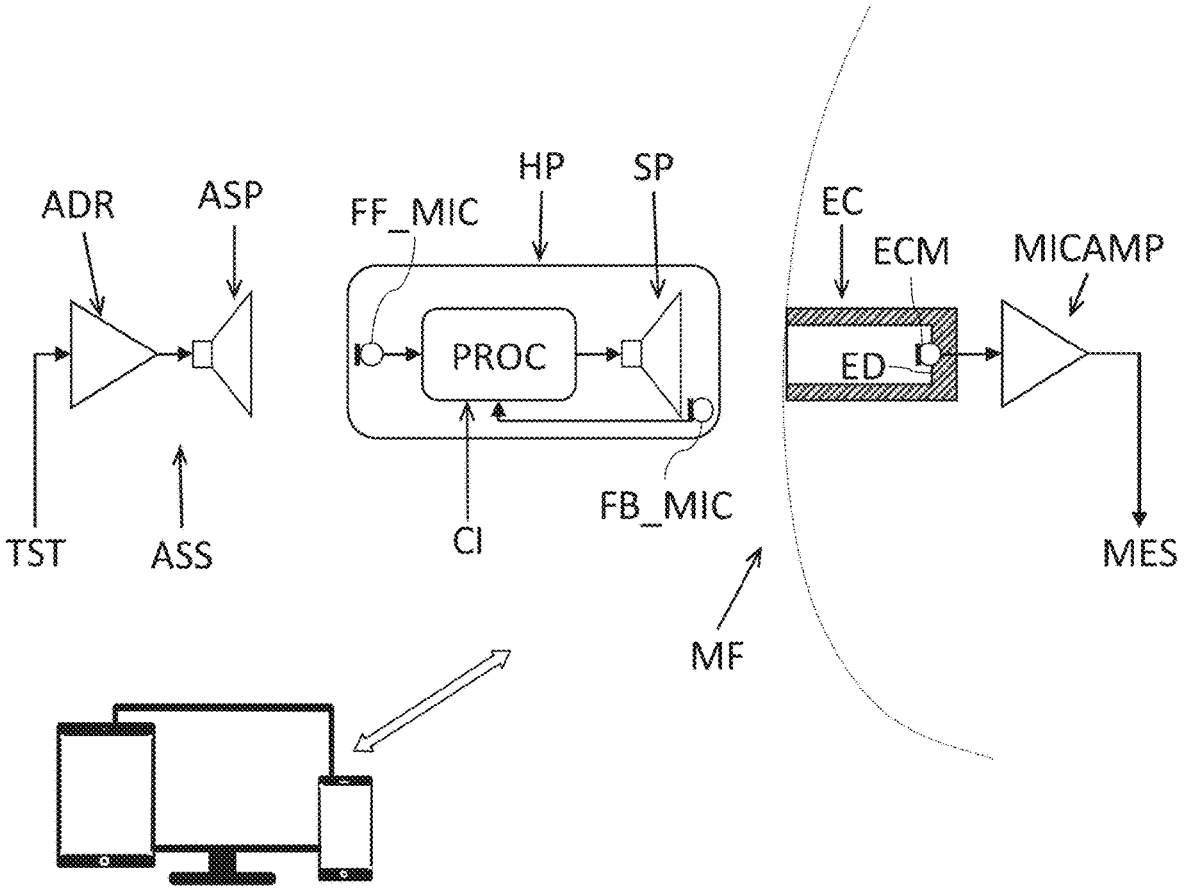
FIG. 2 shows an example implementation of a measurement configuration according to an aspect of the improved tuning concept.

For example, the acoustic transfer functions can be determined by measurement. FIG. 2 shows an example implementation of a measurement configuration that may be used with the improved tuning concept. The measurement configuration includes an ambient sound source ASS comprising an ambient amplifier ADR and an ambient speaker ASP for playing a test signal TST. The noise cancellation enabled audio system including the headphone HP comprises the microphones FB_MIC, FF_MIC, whose signals are processed by a noise processor PROC and output via the speaker SP. The noise processor PROC may feature a control interface CI, over which processing parameters of the noise processing PROC can be set. The headphone HP as an example of an ear-mountable playback device may be in contact with an external control device like a personal computer, a tablet computer or a mobile phone, for example, for exchanging measurement data and/or controlling functions of the headphone HP.

The headphone HP is placed onto a measurement fixture MF, which may be an artificial head with an ear canal representation EC, at the end of which a test microphone ECM is located for recording a measurement signal MES via a microphone amplifier MICAMP. It should be noted that at least a measurement fixture MF and ambient sound source ASS are represented in their basic functions, namely playing a test signal TST and recording a measurement signal MES without excluding more sophisticated implementations. It should be apparent to the skilled reader that the four, respectively five, acoustic transfer functions can be determined with such a measurement configuration.

Figure 3:
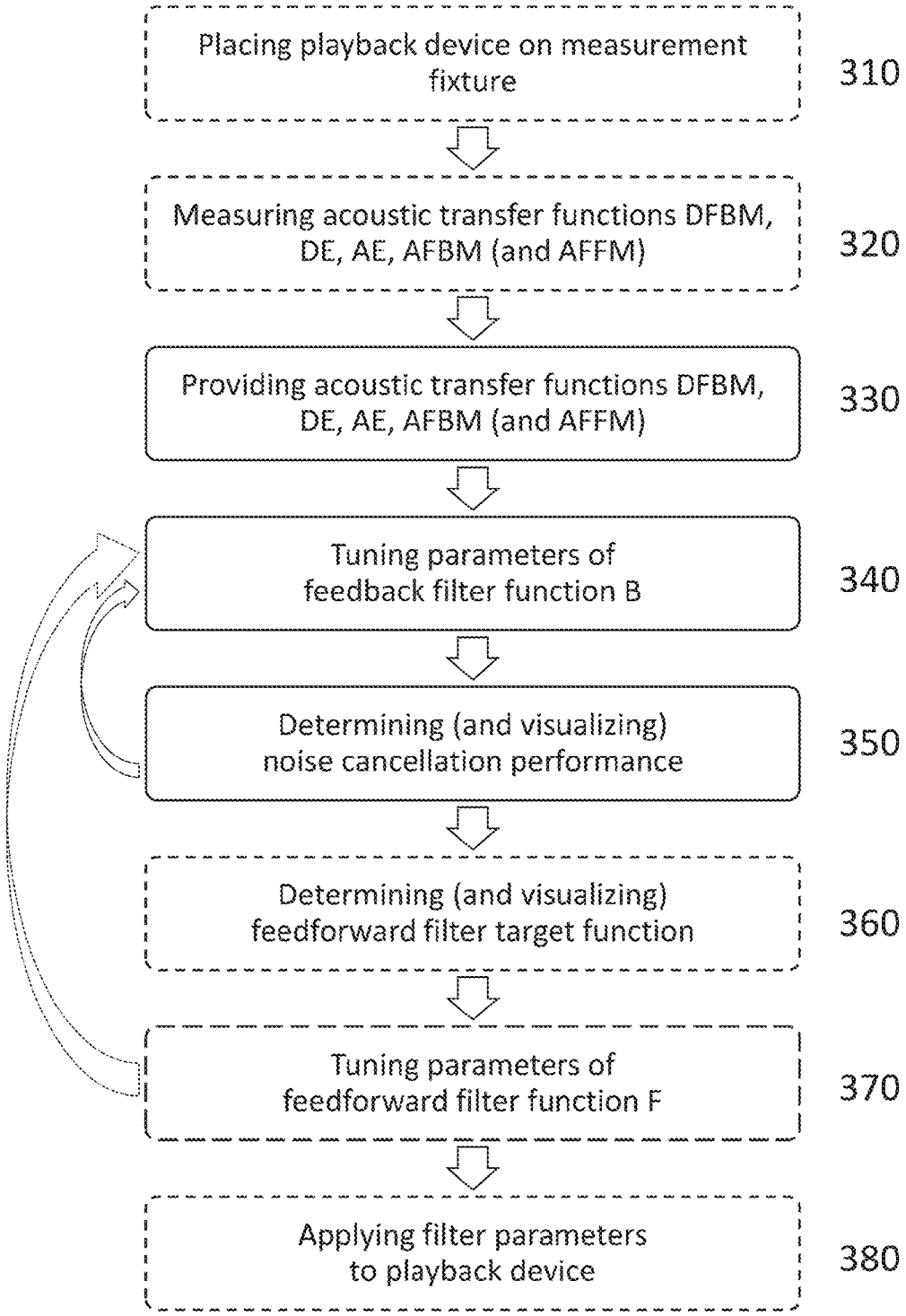
FIG. 3 shows an example implementation of a method according to the improved tuning concept.

Referring now to FIG. 3, an example block diagram showing a method flow of a method for tuning filter parameters of a noise cancellation enabled audio system with an ear-mountable playback device is shown. As shown in block 310, the playback device is placed on the measurement fixture, like that shown in FIG. 2, for measuring four or five acoustic transfer functions DFBM, DE, AE, AFBM and, optionally, AFFM in block 320. The steps of blocks 310 and 320 are only necessary if the acoustic transfer functions are not available yet. For example, if the tuning of the filters of the noise cancellation enabled audio system is only to be changed from a first configuration to a second configuration, e.g. if the playback device should be tuned to a different sound profile, steps 310 and 320 could be omitted.

Hence, if the four or five acoustic transfer functions are present, they can be provided to the tuning process in block 330.

In block 340, parameters of a feedback filter function B designed to process a feedback noise signal obtained with the feedback noise microphone FB_MIC are tuned, e.g. by a user.

Based on the four transfer functions DFBM, DE, AE, AFBM and based on the parameters of the feedback filter function B, a noise cancellation performance at the eardrum ED is determined. The noise cancellation performance at the eardrum ED may be visualized, such that the user can see the effects of the tuning.

Tuning the parameters in block 340 and determining of the noise cancellation performance in block 350 can be performed repeatedly, for example until a desired noise cancellation performance is achieved with the tuning process.

If the noise cancellation enabled audio system is only configured for FB ANC, the tuning process may end here or the filter parameters of the feedback filter function B may be applied to the playback device or audio system, which will be explained later with reference to block 380.

Determining the noise cancellation performance at the eardrum ED may comprise determining a noise function E at the eardrum ED based on each of the four acoustic transfer functions DFBM, DE, AE, AFBM and on the feedback filter function, wherein the noise cancellation performance is determined based on the noise function and the third acoustic transfer function AE.

The FB ANC at the eardrum ED (and not at the FB microphone FB_MIC) can be visualized, e.g. plotted as the filter function B is tuned, meaning no listening tests are required as one can see what one will hear. This is for example effective in limiting overshoot which can be challenging at this stage as it is often worse at the eardrum.

As described earlier, the noise function E may be determined according to $$E = \frac{AE + B(AE.DFBM - AFBM.DE)}{1 + B.DFBM} \tag{1}$$

and the noise cancellation performance ANC may be determined according to $$ANC = \frac{E}{AE}. \tag{2}$$

In conventional approaches, an error signal e, or residual noise signal is used, representing the noise present at the FB microphone FB_MIC after cancellation. The ANC performance ANCMIC at the FB microphone FB_MIC can be calculated as $$ANCMIC = \frac{e}{AFBM} = \frac{1}{1 + B.DFBM}. \tag{5}$$

From equation (2) it can be seen that if the difference between the product AE.DFBM and AFBM.DE is zero (that is the difference between the driver responses is the same as the difference between the ambient responses) then the term in brackets falls to 0 and the ANC is equal to equation (5).

To derive the expression of equation (1), the signals at the FB microphone FB_MIC and at the eardrum ED can be analyzed:

The noise at the FB microphone is given by:

$$e = AFBM - e.B.DFBM \tag{6}$$

or $$e = \frac{AFBM}{1 + B.DM}. \tag{7}$$

The noise at the eardrum is given by:

$$E = AE - e.B.DFBM\left(\frac{DE}{DFBM}\right). \tag{8}$$

That is the signal at the FB microphone (e.B.DFBM) multiplied by the transfer function between the FB microphone and the DRP relative to the driver which combines with the ambient noise at the ear, AE via superposition.

With equation (7), E results to $$E = AE - \frac{AFBM.B.DFBM}{1 + B.DFBM}\left(\frac{DE}{DFBM}\right), \tag{9}$$

which leads to the expression of equation (1).

If a hybrid ANC audio system is tuned, in block 360 a feedforward filter target function is determined and optionally visualized. To this end, a first adjusted acoustic transfer function DE' between the speaker SP and the eardrum ED is determined based on the first and the second acoustic transfer functions DFBM, DE and on the feedback filter function B. Furthermore, a second adjusted acoustic transfer function AE' between the ambient sound source ASS and the eardrum ED is determined based on each of the four acoustic transfer functions DFBM, DE, AE, AFBM and on the feedback filter function B. The feedforward filter target function is determined based on the first and second adjusted acoustic transfer functions DE' and AE' and on the fifth acoustic transfer function AFFM.

As described earlier, the first adjusted acoustic transfer function DE' is determined according to $$DE' = \frac{DE}{1 + B.DFBM} \tag{3}$$

and the second adjusted acoustic transfer function AE' is determined according to $$AE' = \frac{AE + B(AE.DFBM - AFBM.DE)}{1 + B.DFBM}. \tag{4}$$

The conventional approach to calculating a FF Target response is as follows:

$$FFTarget_{conv} = \frac{AE}{AFFM.DE}. \tag{10}$$

However, both AE and DE are subject to FB ANC.

In the case of the FB ANC being applied to DE, it can be assumed that DE is the noise source and is equal to AE and therefore AFBM=DFBM. The more accurate equation for FB ANC at the ear, see equations (1) and (2), then reduces to $$ANC_{DE} = \frac{1}{1 + B.DFBM}, \tag{11}$$

resulting in equation (3).

In the case of the FB cancellation being applied to AE, AE does not equal DE, and the full equation (1) applies. This results in $$ANC_{AE} = \frac{E}{AE} \tag{12}$$

and $$AE' = ANC_{AE}.AE, \tag{13}$$

where AE' is the ambient-to-ear acoustic transfer function with the FB noise cancellation applied, and DE' is the driver-to-ear transfer function with the FB noise cancellation applied.

Finally, as the FB ANC at the ear typically differs from the FB ANC at the FB microphone, we can see that the FF filter target function FFTarget has a different response when FB ANC is active:

$$FFTarget = \frac{AE'}{AFFM.DE'} \tag{14}$$

Based on the feedforward target function FFTarget, the parameters of the feedforward filter function F can be tuned in block 370.

For example, if no sufficient result can be achieved in the tuning of the feedforward filter function, it may be chosen to adapt the parameters of the feedback filter function B, thereby returning to block 340. However, the results of the retuning can be immediately determined and visualized such that, for example, a new, updated feedforward filter target function is determined for having a basis for retuning the parameters of the feedforward filter function F.

After the tuning is finished in block 370, the filter parameters, both of the feedforward filter and of the feedback filter, can be applied to the playback device, or if several playback devices of the same type are available, to these playback devices.

For example, several noise cancellation enabled audio systems, in particular the ear-mountable playback devices, may be manufactured in a common process, for example in the same lot, such that the acoustic properties of the playback devices can be assumed identical or nearly identical with negligible production tolerances. As a consequence, it can be assumed that the same filter parameters work for all of the playback devices with the same or similar performance. Hence, one playback device could be used for measuring the respective acoustic transfer functions, as for example described in conjunction with FIG. 2, and the results could be used for the tuning process, eventually resulting in the filter parameters for the feedback filter and, optionally, the feedforward filter. These filter parameters can now be applied to all playback devices or noise cancellation enabled audio systems of the lot. Hence, the effort for manufacturing noise cancellation enabled audio systems is reduced.

The improved tuning concept is for example applied at a design stage, potentially on units that are not fully assembled, or in different states of assembly. Particularly, the improved tuning concept is used before shipment and use of the noise cancellation enabled audio system with the ear-mountable playback device.

In some implementations, measurements can be performed with two or more playback devices of the same type or production lot, such that for example an average of the resulting transfer functions is used for the tuning process. Still, the effort for manufacturing noise cancellation enabled audio systems is reduced.

In summary, as the FB filter is tuned, the FF target response changes are compensated for, e.g. within a design tool, and ultimately the end noise cancellation prediction is far more accurate than with conventional approaches. For example, the FF target response can be calculated and the two filters, FF and FB, can be tuned together.

Often the FB ANC can put a peak or trough in the FF target response which results in substantially less FF ANC in that region, and can be difficult to match with the existing conventional tuning process. Aspects of the improved tuning concept inter alia offer the ability to look at how easy or difficult the FF target filter response is to match, and change the FB filter to make the FF target easier to match to make the end hybrid noise cancellation result as optimal as possible. For example, if the FB ANC is quite different at the FB microphone and the ear, then this may produce a FF target response that has a high Q peak or trough which could be difficult to match with the FF filter. The FB filter could be re-tuned to minimize this effect therefore maximizing the overall hybrid ANC performance. It may be the case for example, that by reducing the FB ANC by 3 dB, results in a smoother, easier to match FF target and an increase of 10 dB in the FF ANC, resulting in a hybrid ANC improvement of 7 dB.

This stems from a new understanding about the relationship of the FB system and the FF system and how the FB system differs at the ear. Ultimately, a new formula has been derived which is accurate for both FF ANC and FB ANC, and in fact can be used to calculate the ANC performance of a system at the ear regardless of where the microphones are placed. This understanding can then be leveraged by implementing into a filter tuning tool, e.g. implemented in a tuning method, a tuning system or in software for implementing such methods or systems, to predict more accurate FB and/or hybrid ANC.

An alternative embodiment would be to make measurements of some or all of the acoustic transfer functions: AFBM, AFFM, DFBM, and calculate or estimate AE' and DE' in a live adaptive noise cancellation system such that the parameters of the FF system can be adjusted accurately.

Application of the improved tuning concept achieves that better ANC performance can be produced. Furthermore, if the tuning method according to the improved tuning concept is implemented in a design tool, complexity and time in development of ANC enabled audio systems can be reduced. Furthermore, if ANC processors for implementing the ANC function are provided by a supplier to a manufacturer of the final noise cancellation enabled audio system, less interaction, e.g. support is necessary for the manufacturer.

Figure 4:
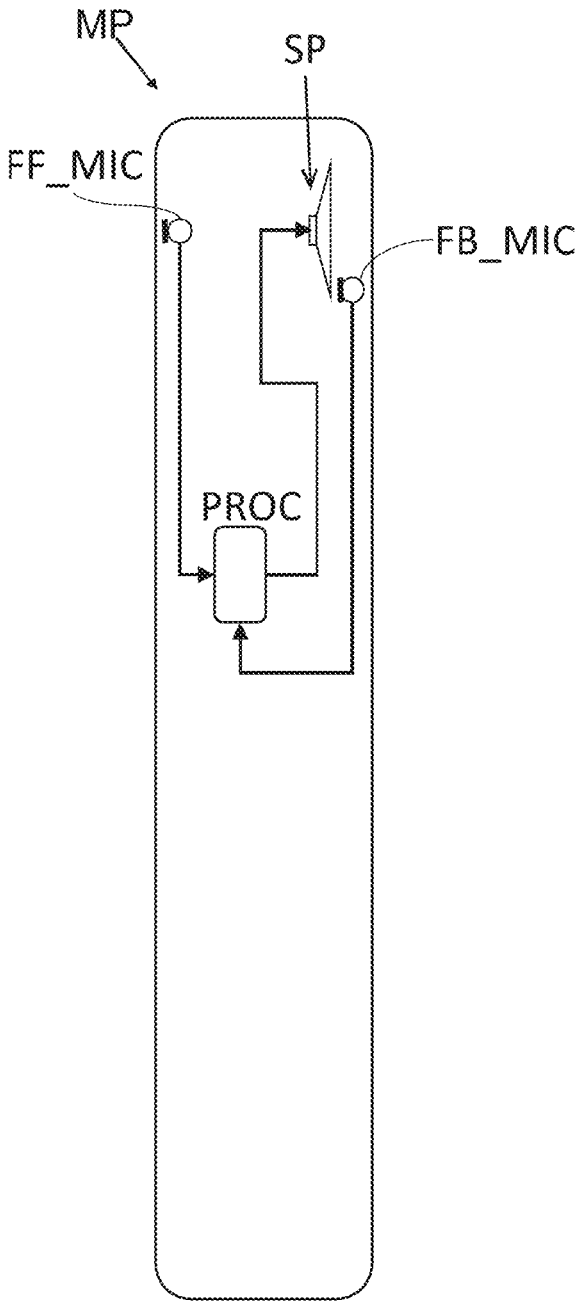
FIG. 4 shows an example implementation of a noise cancellation enabled handset.

Referring now to FIG. 4, another example of a noise cancellation enabled audio system is presented. In this example implementation, the system is formed by a mobile device like a mobile phone MP that includes the playback device with speaker SP, feedback microphone FB_MIC, ambient noise microphone FF_MIC and a processor PROC for performing the ANC during operation.

In a further implementation, not shown, a headphone HP, e.g. like that shown in FIG. 1, can be connected to the mobile phone MP wherein signals from the microphones FB_MIC, FF_MIC are transmitted from the headphone to the mobile phone MP, in particular the mobile phone's processor PROC for generating the audio signal to be played over the headphone's speaker. For example, depending on whether the headphone is connected to the mobile phone or not, ANC is performed with the internal components, i.e. speaker and microphones, of the mobile phone or with the speaker and microphones of the headphone, thereby using different sets of filter parameters in each case.

The invention claimed is:

1. A method for tuning filter parameters of a noise cancellation enabled audio system with an ear mountable playback device comprising a speaker and a feedback noise microphone located in proximity to the speaker, the method comprising:

providing a first acoustic transfer function between the speaker and the feedback noise microphone;

providing a second acoustic transfer function between the speaker and an eardrum being exposed to the speaker;

providing a third acoustic transfer function between an ambient sound source and the eardrum;

providing a fourth acoustic transfer function between the ambient sound source and the feedback noise microphone;

tuning parameters of a feedback filter function being designed to process a feedback noise signal obtained with the feedback noise microphone; and determining a noise cancellation performance of the audio system at the eardrum based on each of the first, second, third and fourth acoustic transfer functions and on the feedback filter function.

2. The method according to claim 1, wherein the method is carried out in a design stage of the noise cancellation enabled audio system and/or the ear-mountable playback device, in particular before shipment and/or use of the noise cancellation enabled audio system with the ear-mountable playback device.

3. The method according to claim 1, further comprising visualizing the noise cancellation performance, wherein the steps of tuning parameters, determining and visualizing are performed repeatedly.

4. The method according to claim 1, wherein determining the noise cancellation performance comprises:

determining a noise function at the eardrum based on each of the first, second, third and fourth acoustic transfer functions and on the feedback filter function; and determining the noise cancellation performance based on the noise function and the third acoustic transfer function.

5. The method according to claim 4, wherein the noise function E is determined according to $$E = \frac{AE + B(AE.DFBM - AFBM.DE)}{1 + B.DFBM}$$

and the noise cancellation performance ANC is determined according to $$ANC = \frac{E}{AE},$$

with DFBM being the first acoustic transfer function, DE being the second acoustic transfer function, AE being the third acoustic transfer function, AFBM being the fourth acoustic transfer function and B being the feedback filter function.

6. The method according to claim 1, wherein the noise cancellation performance at the ear drum is determined differently as compared to a further noise cancellation performance at the feedback noise microphone.

7. The method according to claim 1, wherein the playback device further comprises an ambient noise microphone for obtaining a feedforward noise signal and the audio system is configured for performing both feedback noise cancellation based on the feedback noise signal and feedforward noise cancellation based on the feedforward noise signal, the method further comprising:

providing a fifth acoustic transfer function between the ambient sound source and the ambient noise microphone;

determining a first adjusted acoustic transfer function between the speaker and the eardrum based on the first acoustic transfer function (DFBM), the second acoustic transfer function and on the feedback filter function;

determining a second adjusted acoustic transfer function between the ambient sound source and the eardrum based on each of the first, second, third and fourth acoustic transfer functions and on the feedback filter function;

determining a feedforward filter target function based on the first and second adjusted acoustic transfer functions and on the fifth acoustic transfer function; and tuning parameters of a feedforward filter function being designed to process the feedforward noise signal.

8. The method according to claim 7, further comprising visualizing the feedforward filter target function.

9. The method according to claim 7, wherein the first adjusted acoustic transfer function DE' is determined according to $$DE = \frac{DE}{1 + B.DFBM}$$

and the second adjusted acoustic transfer function AE' is determined according to $$AE' = \frac{AE + B(AE.DFBM - AFBM.DE)}{1 + B.DFBM},$$

with DFBM being the first acoustic transfer function, DE being the second acoustic transfer function, AE being the third acoustic transfer function, AFBM being the fourth acoustic transfer function and B being the feedback filter function.

10. The method according to claim 1, further comprising measuring the first, second, third and fourth acoustic transfer functions with the playback device placed on a measurement fixture, in particular a head and torso simulator, HATS.

11. A method for manufacturing noise cancellation enabled audio systems, the method comprising:

manufacturing one or more audio systems together with a respective associated ear mountable playback device comprising a speaker and a feedback noise microphone located in proximity to the speaker;

tuning filter parameters of a feedback filter function (B) with a method according to claim 1, wherein the first, second, third and fourth acoustic transfer functions are determined, in particular determined beforehand, employing at least one of the one or more audio systems; and applying the filter parameters to the one or more audio systems.

12. A non-transitory computer-readable storage medium storing instructions thereon, the instructions when executed by a processor cause the processor to:

receive a first acoustic transfer function between a speaker and a feedback noise microphone located in proximity to the speaker, the speaker and the feedback noise microphone being comprised by an ear mountable playback device in a noise cancellation enabled audio system;

receive a second acoustic transfer function between the speaker and an eardrum being exposed to the speaker;

receive a third acoustic transfer function between an ambient sound source and the eardrum;

receive a fourth acoustic transfer function between the ambient sound source and the feedback noise microphone;

provide an interface for tuning of parameters of a feedback filter being designed to process a feedback noise signal obtained with the feedback noise microphone; and determine a noise cancellation performance of the audio system at the eardrum based on each of the first, second, third and fourth acoustic transfer functions and on the feedback filter function.

13. The computer-readable storage medium according to claim 12, wherein the interface for tuning of parameters includes visualizing the noise cancellation performance.

14. The computer-readable storage medium according to claim 12, wherein the playback device further comprises an ambient noise microphone for obtaining a feedforward noise signal and the audio system is configured for performing both feedback noise cancellation based on the feedback noise signal and feedforward noise cancellation based on the feedforward noise signal, wherein the instructions further cause the processor to:

provide a fifth acoustic transfer function between the ambient sound source and the ambient noise microphone;

determine a first adjusted acoustic transfer function between the speaker and the eardrum based on the first acoustic transfer function, the second acoustic transfer function and on the feedback filter function;

determine a second adjusted acoustic transfer function between the ambient sound source and the eardrum based on each of the first, second, third and fourth acoustic transfer functions and on the feedback filter function;

determine a feedforward filter target function based on the first and second adjusted acoustic transfer functions and on the fifth acoustic transfer function; and provide an interface for tuning parameters of a feedforward filter function being designed to process the feedforward noise signal.

15. A tuning system for tuning filter parameters of a noise cancellation enabled audio system with an ear mountable playback device comprising a speaker and a feedback noise microphone located in proximity to the speaker, the tuning system being configured to:

receive a first acoustic transfer function between the speaker and the feedback noise microphone;

receive a second acoustic transfer function between the speaker and an eardrum being exposed to the speaker;

receive a third acoustic transfer function between an ambient sound source and the eardrum;

receive a fourth acoustic transfer function between the ambient sound source and the feedback noise microphone;

provide an interface for tuning of parameters of a feedback filter being designed to process a feedback noise signal obtained with the feedback noise microphone; and determine a noise cancellation performance of the audio system at the eardrum based on each of the first, second, third and fourth acoustic transfer functions and on the feedback filter function.

16. The tuning system according to claim 15, wherein the playback device further comprises an ambient noise microphone for obtaining a feedforward noise signal and the audio system is configured for performing both feedback noise cancellation based on the feedback noise signal and feedforward noise cancellation based on the feedforward noise signal, wherein the tuning system is further configured to:

receive a fifth acoustic transfer function between the ambient sound source and the ambient noise microphone;

determine a first adjusted acoustic transfer function between the speaker and the eardrum based on the first acoustic transfer function, the second acoustic transfer function and on the feedback filter function;

determine a second adjusted acoustic transfer function between the ambient sound source and the eardrum based on each of the first, second, third and fourth acoustic transfer functions and on the feedback filter function;

determine a feedforward filter target function based on the first and second adjusted acoustic transfer functions and on the fifth acoustic transfer function; and provide an interface for tuning parameters of a feedforward filter function being designed to process the feedforward noise signal.

* * * * *